United States Patent [19]

Göessler

[11] 4,205,292

[45] May 27, 1980

[54] ELECTRIC TIME SWITCH

[75] Inventor: Gerhard Göessler, Oberderdingen, Fed. Rep. of Germany

[73] Assignee: E.G.O. Elektro-Geraete Blanc und Fischer, Fed. Rep. of Germany

[21] Appl. No.: 918,172

[22] Filed: Jun. 22, 1978

[30] Foreign Application Priority Data

Jul. 6, 1977 [DE] Fed. Rep. of Germany ..... 2730446

[51] Int. Cl.[2] ..... H01H 71/16; H01H 71/22

[52] U.S. Cl. ..... 337/101; 219/486; 337/104; 337/105

[58] Field of Search ..... 337/100–102, 337/104, 105; 219/485–487, 511; 236/1 ER

[56] References Cited

U.S. PATENT DOCUMENTS

| | | | |
|---|---|---|---|
| 3,587,023 | 6/1971 | Göessler et al. | 219/511 X |
| 3,713,062 | 1/1973 | Butler et al. | 337/102 X |

*Primary Examiner*—R. L. Moses

*Attorney, Agent, or Firm*—Steele, Gould & Fried

[57] ABSTRACT

An electric time switch mechanism is provided comprising a plurality of units each having an operating thermal expansion member, for example, a bimetallic member. Electrical heating means are provided for the thermal expansion member and a switch is activated by the thermal expansion member. The units are connected in series in such a way that the activation of a switch turns off the heating means of the associated thermal expansion member and turns on that of the following units. The switches remain in the activated state after activation and are resettable by external activation.

18 Claims, 3 Drawing Figures

ELECTRIC TIME SWITCH

FIELD OF THE INVENTION

The invention relates to an electric time switch mechanism which operates with an electrically heated thermal expansion member, for example a bimetallic member.

BACKGROUND OF THE INVENTION

Time switch mechanisms have been proposed in which a heated bimetallic member activates a mechanical ratchet which, after heating the bimetallic member, releases a component under spring tension which advances one step. Thus, several heating cycles and cooling cycles of the bimetallic member may be connected in succession, to prolong the switching time in relation to the mere single heating of the bimetallic member. However, with these time switch mechanisms, the switching time can only be adjusted in steps and the mechanism is also relatively expensive and, like all mechanisms, is liable to break down and is exposed to wear.

SUMMARY OF THE INVENTION

An object of the invention is therefore to provide a time switch mechanism which is simple and compact with an improved switching behaviour.

According to the invention there is provided an electric time switch mechanism comprising a plurality of units each having an operating thermal expansion member, electrical heating means for the thermal expansion member and a switch which is activated by the thermal expansion member, the units being connected in series in such a way that the activation of a switch turns off the thermal expansion member heating means of the associated thermal expansion member and turns on that of the following units, the switches remaining in the activated state after activation and being resettable by external activation.

A cascade of thermal expansion members, for example bimetallic members, is thus provided each of which has a switch as the single mechanical member. An adjusting device can preferably be provided for stepless adjustability, by means of which adjusting device the position of at least one, and preferably all, of the bimetallic members can be adjusted in relation to the associated switch. The time switch mechanism can thus be adjusted steplessly to a period ranging from the shortest period up to the maximum period.

The maximum period can be long since the heating means of the bimetallic members may be designed so as to be affected by mass or so as to be inert. They also make the maximum period available, unlike those in which the same bimetallic member is repeatedly heated, since the latter are not completely cooled during the following cycles. Although bimetallic members are referred to primarily herein, the thermal expansion elements could take some other form, for example they could be expansion rods, tubes or the like, although bimetallic members are particularly preferred owing to their large bending capacities.

DESCRIPTION OF PREFERRED EMBODIMENTS

Figure 1:
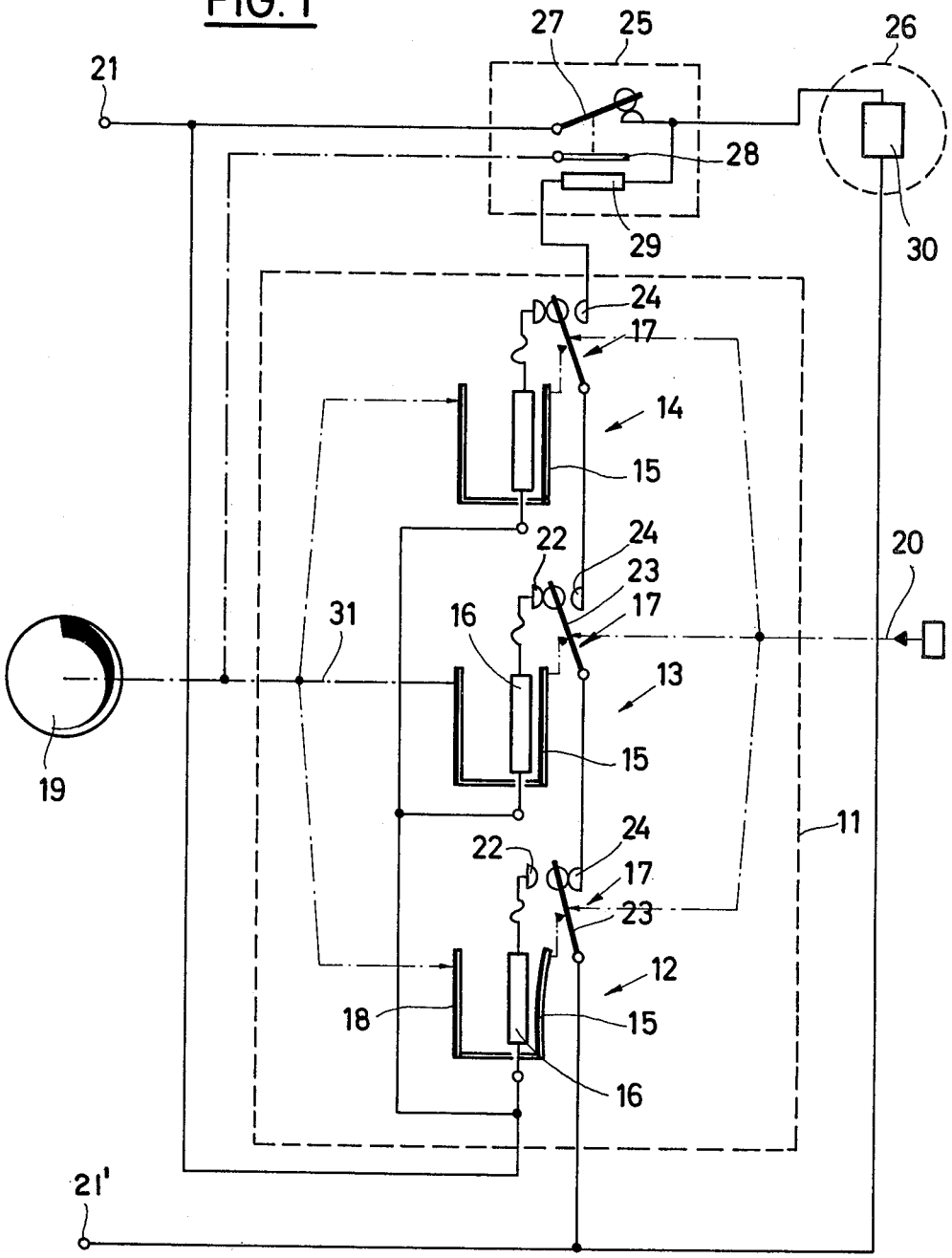
FIG. 1 is a schematic circuit diagram of a time switch mechanism according to the invention with three units.

FIG. 1 shows a time switch mechanism 11 comprising three units 12, 13 and 14 each of which has an operating bimetallic member 15, an associated electric heating means 16 and a switch 17. Each operating bimetallic member is provided with a compensation bimetallic member 18 for compensating the ambient temperature, by means of which the position of the operating bimetallic member may be adjusted in relation to the switch 17 upon which it acts. All three units 12, 13, 14 are adjustable together by means of a toggle 19.

The switches 17 are snap switches which snap from the position shown for the units 13 and 14 into the position shown for the unit 12 and remain in this position until they are forced back into the position shown for the units 13 and 14 by means of an external activation means which is indicated here as a manual press-button activation means 20.

In the illustrated embodiment the heating means 16 of the operating bimetallic member 15 are joined to a connection 21 of a domestic power supply network and communicate with a contact 22 of the switch 17. The moving switch members 23 of the switches 17 and the other counter-contacts 24, (which are contacted after the snapping of the switch member) are arranged in series in such a way that a second connection 21' of the power supply network communicates either with the contact 22 or, by means of the switch, member 23 and the other counter-contact 24, with the switch member of the next unit.

FIG. 1 also shows a power control instrument 25 for an electric cooker plate 26 which has a snap switch 27. The snap switch 27 is activated by a bimetallic member 28 heated by a heating means 29. This is a pulsation power control instrument known per se which supplies power to the heating resistance 30 of the electric cooker plate in pulses of a duration which varies depending on the adjustment. The power control instrument is also adjustable by means of the toggle 19 by means of which the time switch mechanism is also adjusted. The heating means 29 of the power control instrument is switched by the time switch mechanism 11 and is connected to the contact 24 of the last unit 14 of the time switch mechanism. The other pole of the heating means 29 is connected via the switch 27 of the power control instrument to the connection 21 so that the heating means of the power control instrument switches itself.

The time switch mechanism shown in FIG. 1 is designed as a device for starting cooking with a power-controlled cooker plate. With these cooker plates, the power is adjusted manually and steplessly, so that with adjustment to a lower continuous cooking value which usually lies in the order of magnitude below a quarter of the total power of the cooking plate, initial cooking would take a very long time. The time switch mechanism 11 is therefore designed to prevent pulsation, that is to say the periodic turning on and off of the switch 27 of the power control instrument 25, for a predetermined initial cooking period. In the time switch mechanism according to the invention the coupling between the adjustment of the power control instrument and the time switch mechanism is advantageously such that for the duration of the initial cooking phase the full power of the electric cooker plate according to the adjusted continued-cooking power is applied. This takes into consideration the fact that the housewife, when using a saucepan with large amount of contents requiring a long initial cooking time, normally also adjusts the continued cooking power higher than with a smaller amount of material to be cooked.

The time switch mechanism shown in FIG. 1 operates as follows. After adjusting the desired power and thus also the running time of the time switch mechanism by means of the toggle 19, the pivotally mounted bimetallic members composed of compensation bimetallic member 18 and operating bimetallic member 15 are brought into a predetermined position in relation to their switches 17. Following the previous initial cooking procedure, all switches 17 were in the position shown with the unit 12, that is to say the switch members 23 were connected to the contacts 24. The housewife now starts up the initial cooking operation by activating the press-button 20. The switch members 23 of all three switches 17 are thus made to snap over in an anticlockwise direction and are now in contact with the contacts 22. The heating means 16 of the operating bimetallic member 15 is thus firstly switched on with the unit 12 and upon completion of the heating-up time of the bimetallic member 15, which is preferably selected to be quite long, the bimetallic member 15, in accordance with its adjustment by the adjusting device 31 activated by the toggle 19, brings the switch member 23 of the switch 17 to snap into the position shown in FIG. 1. The heating means 16 of the unit 12 thus becomes free from current and the operating bimetallic member cools down again, but does not cause the switch member 23 to snap back into the previous position owing to the action of the switch 17.

It should be noted that the heating means 16 of the unit 13 is thus switched on and now also carries out the operating cycle described above. After switching over the switch 17 of the unit 13, the unit 14 is started up in the same way, and after the unit 14 has been switched, the heating means 29 of the power control instrument 25 receives current via the three switches 17 of the time switch mechanism with their switch members 23 and 24, and the normal pulsation operating of the power control instrument is initiated.

It should therefore be noted that with the time switch mechanism according to the invention, the switching times of the individual units 12, 13, 14 add up so that considerable maximum periods are achieved. However, owing to the adjustability of all three units, this period can also be adjusted to small values if desired. It would of course also be possible to make only individual units adjustable and allow some (the basic time, so to speak) to run constantly. It is also feasible to perform the turning on operation by means of an alternative type of activation (for example by means of a rotatable member or by means of cams) instead of using the pressure activation means 20. Furthermore, it is feasible to switch the switch 17 into its starting position as soon as the toggle 19 is turned back to zero. In this case, the time switch mechanism would run automatically with each initial cooking operation.

Figure 2:
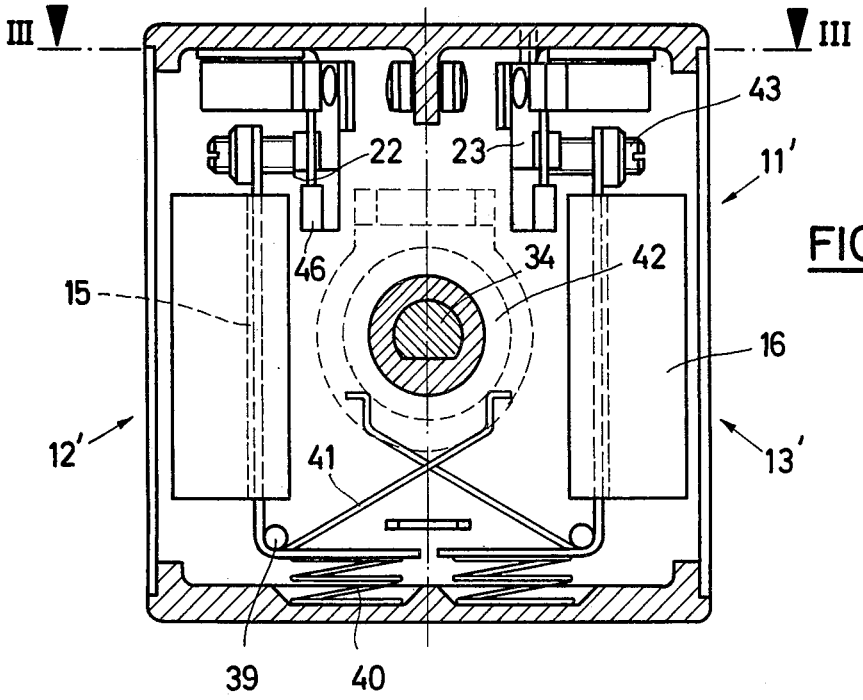
FIG. 2 is a plan view of an embodiment with two units.
Figure 3:
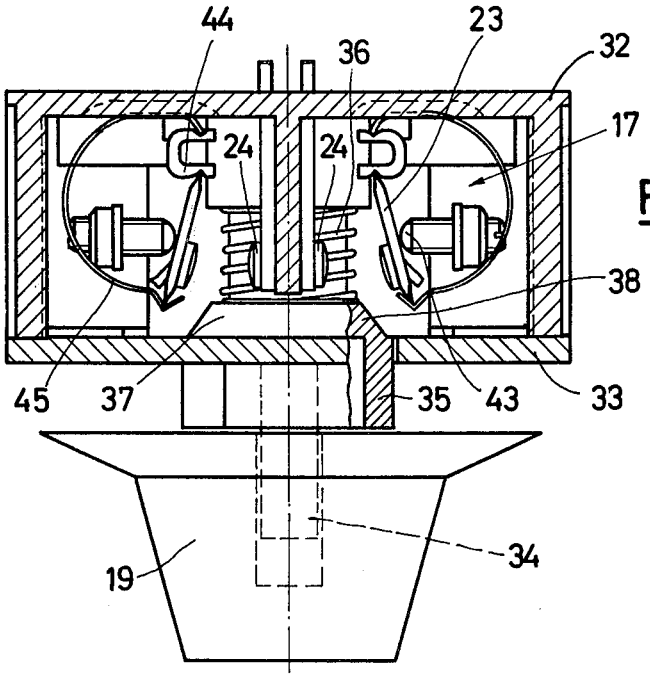
FIG. 3 is a section along line III—III in FIG. 2.

FIGS. 2 and 3 show an embodiment of a time switch mechanism 11' which has only two units 12', 13'. It is placed in a substantially square flat housing 32 which is sealed with a cover 33 through which passes an adjusting shaft 34 in the direction of its smallest dimension.

Owing to its flat structure, the time switch mechanism 11' is particularly suitable for use as an adaptor switch for a power control instrument, that is to say a power control instrument of the same basic dimensions can be joined directly on to its rear and thus be made into a block with the time switch mechanism. The adjusting shafts of both instruments can engage in each other.

The adjusting shaft 34 can be rotated by the toggle 19. Furthermore, the toggle 19 may be pressed towards the time switch mechanism so that it presses a tube 35 against the force of a compression spring 36 surrounding the adjusting shaft. The tube is joined to a resetting cam 37 with two oblique surfaces 38 for resetting the switch members 24 of the switches 17.

The operating bimetallic members 15 of the two units 12', 13' are arranged parallel to each other on opposite sides of the adjusting shaft 34, transversely to its axis, and are pivotal about shafts 39 extending parallel to the adjusting shaft. Swivelling levers 41 are pressed on to an adjusting curve 42 fixed on the adjusting shaft 34 by means of an angle piece and compression springs 40. The swivelling levers are also formed of bimetallic material and form the compensation bimetallic members.

The heating means 16 of the operating bimetallic members 15 are of large thermal capacity and are thermally well connected to the bimetallic members, so that the time constants of the bimetallic member are relatively large. The power can be supplied to these heating means either by means of the shafts 39 or the compression springs 40 or by means of separate moving supply lines.

The free ends of the operating bimetallic members 15 act by means of adjusting screws 43 which also form the contacts 22 on the switch members 23. The members 23, as shown particularly in FIG. 3, consist of flat plates having tapering edges which rest on a single-thrust bearing 44 and on a C-shaped spring 45 which puts the switch member 23 under an initial compression. Each spring 45 is supported at its other end on and one of the single-thrust bearings 44. The switch members 23 co-operate with two fixed counter-contacts 24 which are separated by an insulating wall and are arranged back to back between the two switches 17 arranged in a mirror image relationship. The switch members 23 each have a projection pointing toward the centre of the switch, on which projection bevelled tabs 46 are formed which are able to co-operate with the resetting cam 37 when the switch member is snapped over into the position in which it contacts its counter-contact 24. Since the dead-centre of the bow-spring 45 is overstepped when the switch member is snapped over to this position, the switch member 23 does not spring back into the starting position shown when the bimetallic member cools down and re-adopts the outward-pivoted position shown.

It should be noted that the design of the switches 17 is particularly simple. Thus, the bimetallic heating means 16 make contact directly above the point of support, that is to say the adjusting screw 43, and no special counter-contact is required. The construction of the time switch mechanism is simple, requires few mechanical and electrical components and is compact.

Although in the embodiment shown in FIGS. 2 and 3, a successive switching of two units ensures a sufficient period for initial cooking operations, it is possible to produce other desired period by means of a larger number of units, for example if the time switch mechanism is used for other purposes apart from controlling the initial cooking time of electric cooker plates.

I claim:

1. An electric time switch mechanism comprising a plurality of units each having an operating thermal expansion member, electrical heating means for the thermal expansion member and a switch which is activated by the thermal expansion member, the units being connected in series in such a way that the activation of a switch turns off the heating means of the associated thermal expansion member and turns on that of the following unit, the switches remaining in the activated state after activation and being resettable by external activation.

2. A mechanism according to claim 1, wherein the thermal expansion members are bimetallic members.

3. A mechanism according to claim 2, comprising an adjusting device for stepless adjustment, by means of which adjusting device the position of at least one of the bimetallic members may be adjusted relative to the associated switch.

4. A mechanism according to claim 3, wherein the position of all bimetallic members is variable in relation to their switches by means of the regulating device.

5. A mechanism according to claim 2, wherein the switch of the last unit is adapted to switch an output line of the mechanism.

6. A mechanism according to claim 2, wherein the switches are bistable snap switches.

7. A mechanism according to claim 2, wherein the operating bimetallic members are provided with compensation thermal expansion members.

8. A mechanism according to claim 2, wherein the heating means of the operating bimetallic members are designed so as to be affected by mass or so as to be inert.

9. A mechanism according to claim 2, comprising two units whose operating bimetallic members with their respective heating means are arranged on opposite sides of an adjusting shaft projecting between them.

10. A mechanism according to claim 9, wherein the operating bimetallic members are pivotally mounted with their heating means.

11. A mechanism according to claim 10, wherein the said pivotal mounting is achieved by swivelling levers which contain a compensation thermal expansion member and lie against the regulating shaft having a regulating cam surface.

12. A mechanism according to claim 2, wherein each switch has a moving switch member which is supported in a support mounting, is urged against the support mounting by a spring under an initial compression and is snappably mounted between a contact which moves with the operating bimetallic member and a fixed counter-contact.

13. A mechanism according to claim 12, wherein each said spring is bow-shaped.

14. A mechanism according to claim 12, comprising mechanical pressure or rotating activation means for resetting the switch members.

15. A mechanism according to claim 12, wherein the switch members are arranged substantially parallel to the adjusting shaft.

16. A mechanism according to claim 2, which is designed as an adaptor switch to a control instrument for electric cooker plates.

17. A mechanism according to claim 16, wherein the adjusting device is adapted simultaneously to effect the desired value adjustment of the control instrument.

18. A mechanism according to claim 16, comprising manual activation means for both effecting the said resetting and switching on an initial cooking operation.

* * * * *